United States Patent [19]

Gubany

[11] Patent Number: 4,878,671

[45] Date of Patent: Nov. 7, 1989

[54] YARD GOLF GAME APPARATUS

[76] Inventor: Peter M. Gubany, #6 Oakbriar Farm Ct., Ballwin, Mo. 63021

[21] Appl. No.: 268,984

[22] Filed: Nov. 9, 1988

[51] Int. Cl.[4] ..... A63B 69/36

[52] U.S. Cl. ..... 273/176 R; 273/178 R

[58] Field of Search ..... 273/176 R, 176 A, 176 AA, 273/176 AB, 178 R, 178 A, 178 B, 179 R, 179 A, 179 B, 179 C, 179 D, 179 E, 180, 34 R, 34 A, 34 B, 127 B

[56] References Cited

U.S. PATENT DOCUMENTS 2,121,270 6/1938 Streich ..... 273/180

3,797,833 3/1974 Rokusek ..... 273/178 R

*Primary Examiner*—George J. Marlo

*Attorney, Agent, or Firm*—Senniger, Powers, Leavitt and Roedel

[57] ABSTRACT

A game apparatus including a device for forming a simulated hole for a golf-type game in which players strike a ball to propel it into the hole. The device comprises a generally circular cup sized to receive the game ball, the cup having an opening generally in the center, and a generally frustoconical resilient flange surrounding the cup, the flange sloping downwardly and radially outwardly from the rim of the cup, the lower lip of the flange extending below the bottom of the cup in its uncompressed state. A flag pole for anchoring the apparatus is adapted to extend through the opening in the cup and embed in the ground below the cup. The flag pole includes a plug or other suitable structure for engaging the bottom of the cup to hold the cup down and compress the resilient flange to hold the lip of the flange against the ground.

13 Claims, 1 Drawing Sheet

YARD GOLF GAME APPARATUS

BACKGROUND OF THE INVENTION

This invention relates to game apparatus, and in particular to equipment for playing a golf-type game in a yard.

Golf is a very popular sport, and various attempts have been made to provide equipment for a golf-type game suitable for the home or yard. Reference may be had to Cassel, U.S. Pat. No. 3,752,482; Mulherin, U.S. Pat. No. 3,610,631, and Austin et al., U.S. Pat. No. 838,763, for examples of such equipment. This equipment has not been satisfactory because it was either to bulky or expensive, or did not realistically simulate golf.

SUMMARY OF THE INVENTION

It is among the objects of the present invention to provide a game apparatus of simple and inexpensive construction that can be used to play a realistic golf-type game in a yard. In particular it is among the objects of the present invention to provide a device to simulate a golf hole that is of simple and inexpensive construction; to provide such a device that does not damage the yard or require digging or elaborate installation; to provide such a device that can be easily and securely anchored to the ground; and to provide such a device that has a smooth, continuous contact with the ground without a lip or other obstruction to deflect the ball. It is also among the objects of at least some of the embodiments of the present invention to provide a game apparatus including indicators for delimiting the path for the game ball.

The game apparatus of the present invention is adapted for forming a plurality of holes for a golf-type game in which players strike a ball to propel it into the hole. The apparatus generally comprises a plurality of hole-simulating devices each comprising generally circular cup sized to receive the game ball. There is an opening in the center of the bottom of the cup. A generally frustoconical resilient flange surrounds the cup, sloping downwardly and radially outwardly from the rim of the cup. The lower lip of the resilient flange extends below the bottom of the cup. The device also comprises a flag pole for anchoring the device. The flag pole is adapted to extend through the opening in the cup and embed in the ground below the cup. The flag pole includes means for engaging the bottom of the cup to hold the cup down and compress the resilient flange to hold the lip of the flange against the ground.

The bottom of the cup is preferably conically shaped, raised in the center and sloping downwardly and radially outwardly. The cup preferably includes a recess or socket, surrounding the opening, and the cup engaging means preferably includes a plug on the flag pole adapted to fit in the socket. The sides of the cup are preferably tapered so that the devices can be nested.

In at least some embodiments, the game apparatus also includes a plurality of indicators adapted to be anchored in the ground in spaced apart relation to delimit the path or fairway for the game ball between them. There are preferably at least two pairs of indicators for each hole, each pair of indicators including means for indicating a left or a right turn.

Thus the game apparatus of the present invention can be used to set up a realistic course for a golf-type game in a yard. The apparatus is of simple and inexpensive construction. The indicators define a fairway or path for each hole. These indicators may be used to create holes with left or right turns, for more realistic and challenging play. The hole simulating devices are easily set up, without any digging or other elaborate installation that might damage the yard. The devices are securely anchored to the ground with the flag poles, so that the lip of the resilient flange is compressed against the ground to provide smooth, continuous surface without a lip or other obstruction to deflect the ball.

These and other advantages will be in part apparent and in part pointed out hereinafter.

DETAILED DESCRIPTION OF THE PREFERRED EMBODIMENT

Figure 1:
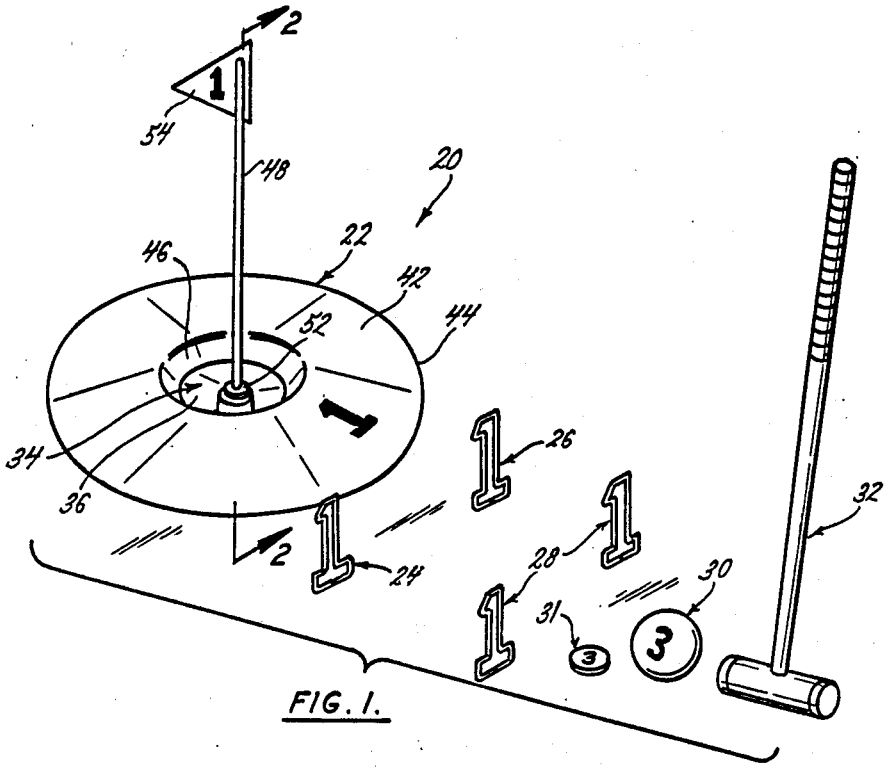
FIG. 1 is a perspective view of the game apparatus of the present invention comprising a hole-simulating device, fairway indicators, a ball, and a club for use in playing a golf-type game.

Game apparatus for playing a yard golf-type game, constructed according to the principles of the present invention, is indicated generally as 20 in FIG. 1. The game apparatus comprises a hole-simulating device 22, a plurality of fairway markers 24 and 26, tee markers 28, a game ball 30, a ball marker 31, and a club 32. There are preferably at least nine hole-simulating devices and nine sets of fairway markers so that a nine hole "course" can be set up in the yard before play begins.

The hole-simulating device 22 is adapted to simulate a hole for a golf-type game in which players strike a ball to propel it into the hole. The apparatus comprises a generally circular cup 34 sized to receive the game ball 28. The cup preferably has a diameter at least twice the diameter of ball 30 (and more preferably 1–2 inches greater than twice the diameter of ball 30 so that the ball 30 can drop easily into the cup) and a depth of at least half of the diameter of ball 30. The cup 32 preferably has a conically shaped bottom 36, raised in the center and sloping downwardly and radially outwardly. A socket 38 is generally positioned in the raised center of bottom 36. There is an opening 40 in the bottom of the socket 38.

A generally frustoconical resilient flange 42 surrounds the cup 32, sloping downwardly and radially outwardly from the rim of the cup. The lower lip 44 of the flange 42 extends below the bottom of the cup when the flange is in its uncompressed state (shown in phantom in FIG. 2). The cup and flange are preferably made integrally from the same material. This material is preferably a relatively stiff but resilient plastic material, such as molded polyethylene. Alternatively, the cup and flange may be made of a flexible and resilient material, such as an artificial rubber. The sidewall 46 of the cup 34 preferably slopes outwardly and upwardly so that the cup 34 can receive an identical cup to allow the devices 22 to be nested for compact storage and handling.

Figure 2:
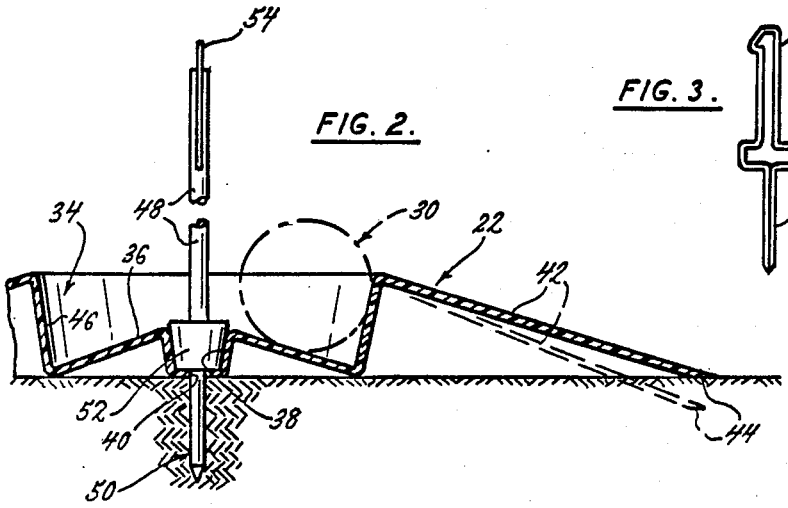
FIG. 2 is a partial cross sectional view of the hole-simulating device, taken along the plane of line 2—2 in FIG. 1.
Figure 3:
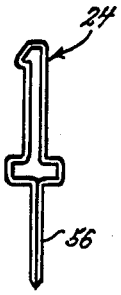
FIG. 3 is a front elevation view of one of the fairway indicators. Corresponding reference numerals indicate corresponding parts throughout the several view of the drawings.

The hole-simulating device 22 also comprises a flag pole 48 for anchoring the device. The lower end 50 of the flag pole is adapted to extend through the opening 40 in the bottom of the socket 38 and embed in the ground below the cup 34. The flag pole 48 also includes means, such as plug 52 for engaging the socket 38 to hold the cup 34 down and compress the resilient flange 42 to hold the lip 44 of the flange against the ground around the entire periphery of lip 44. The plug 52 and the socket 38 preferably have a complementary taper. As described above and as shown in phantom FIG. 2, in the uncompressed state, the lip 44 of the flange 42 extends below the bottom 36 of the cup 34. However, as shown in FIG. 2, the flag pole 48 holds the cup 34 down, compressing the flexible flange 42 and causing it to flex relative to the cup so that the lip 44 is hled firmly against the ground to provide a smooth, continuous surface with the ground, without a lip or other obstruction to deflect the ball. Thus, despite any ground imperfections or unevenness, there is a smooth and continuous transition from the ground to the cup on all sides of the device.

The top of each flag pole can be provided with a flag 54 to indicate the hole number. The flag may be made of plastic sheet and held frictionally in a split in the upper end of the flag pole 48.

The game apparatus also comprises at least two pairs of indicators 24 and 26 for each hole. In the preferred embodiment the indicators comprise outlines of numerals representing the particular hole number, alternatively the indicators may bear some other indicia of the hole number. The indicators 24 and 26 each have an spike 56 adapted to be inserted into the ground to anchor them. The indicators can thus be anchored in the ground in spaced apart relation to delimit a path or fairway for the ball 30 between them. The indicators 24 and 26 preferably include means for indicating right or left turns. For example indicator 24 might be colored red, to indicate a right turn and indicators 26 might be colored blue to indicate a left turn. A red indicator 24 and a blue indicator 26 can be used together to indicate a straight path or fairway, as shown in FIG. 1. A pair of tee markers 28 may be provided to identify the starting point (or tee) for each hole. The markers 28 preferably comprise outlines of numerals representing the particular hole number, alternatively the markers may bear some other indicia of the hole number. The markers 28 are preferably made distinguishable from the indicators. For example, they may be colored white.

The game ball 30 is preferably the size and weight of a croquet ball, for easy rolling on a lawn. The balls 30 may be colored or bear some other indicia to distinguish each player's ball. The markers 31 are preferably flat disks of wood, plastic, or other suitable material. The ball marker preferably has some indicia, similar to the indicia on the balls 30, to distinguish among the markers. The markers are used when one player's ball is blocking another player's shot. A marker 31 is used to mark the position of the blocking ball, so that the ball can be removed and play can continue.

The club 32 may be a croquet mallet or other suitable implement for striking the balls 30 to propel them along the ground, up the flange 42 and into the cup 34.

OPERATION

A device 22 and indicators 24, 26, and 28 are preferably provided for each hole. The game apparatus 20 is set up by positioning each of the hole-simulating devices 22 in the yard. The devices 22 are then anchored by inserting the flag poles 48 through the openings 40 in the bottoms of the cups 34 until the plug 52 engages the socket 38, holding the cup 34 down and compressing the flange 42 until the lip 44 is held firmly against the ground around its entire periphery. The various "holes" are then designed by anchoring the various indicators 24 and 26 and the tee markers 28 in the ground to define the path or fairway for each hole.

Once the course is set up, each player selects a ball 30. Each player takes a turn trying to propel his or her ball 30 from the tee area marked by indicators 28, through the fairway delimited by markers 24 and 26, and into the hole formed by cup 34. The flag poles 48 anchor the hole-simulating device 22 and hold the flanges 42 of each device against the ground to provide a smooth transition so that the balls 30 can be hit into the hole from any side of the device, without interference.

The game is preferably played like regular golf, with the players taking turns based on their score on the previous hole, the lowest scorer having "honors" and going first, and the other players take their turns in order of their score.

In view of the above, it will be seen that the several objects of the invention are achieved and other advantageous results attained.

As various changes could be made in the above constructions without departing from the scope of the invention, it is intended that all matter contained in the above description or shown in the accompanying drawings shall be interpreted as illustrative and not in a limiting sense.

What is claimed is:

1. A game apparatus including a device for forming a simulated hole for a golf-type game in which players strike a ball to propel it into the hole, the device comprising:

a generally circular cup sized to receive the game ball, the cup having an opening generally in the center;

a generally frustoconical resilient flange surrounding the cup, the flange sloping downwardly and radially outwardly from the rim of the cup, the lower lip of the flange extending below the bottom of the cup in its uncompressed state;

a flag pole for anchoring the apparatus, the flag pole adapted to extend through the opening in the cup and embed in the ground below the cup, the flag pole including means for engaging the bottom of the cup to hold the cup down and compress the resilient flange to hold the lip of the flange against the ground.

2. The game apparatus according to claim 1 wherein the bottom of the cup has a generally conical shape, raised in the center and sloping downwardly and radially outwardly.

3. The game apparatus according to claim 1 wherein the cup has a socket therein generally surrounding the opening therein, and wherein the means for engaging the cup comprises a plug on the flag pole adapted to fit in the socket.

4. The game apparatus according to claim 3 wherein the sides of the socket and of the plug have a complementary taper.

5. The game apparatus according to claim 3 wherein the bottom of the cup has a generally conical shape, is raised in the center and slopes downwardly radially outwardly, and wherein the socket is located in the generally raised center.

6. The game apparatus according to claim 1 wherein the sides of the cup slope upwardly and outwardly so that the game apparatus can be nested.

7. The game apparatus according to claim 1 further comprising a plurality of indicators, the indicators adapted to be anchored in the ground in spaced apart relation to define the path for the game ball between them.

8. The game apparatus according to claim 7 wherein there are at least two pairs of indicators for each hole, each pair of indicators including means for indicating a left or a right turn.

9. A game apparatus including a device for forming a simulated hole for a golf-type game in which players strike a ball to propel it into the hole, the apparatus comprising:

a generally circular cup sized to receive the game ball, the cup having upwardly outwardly tapering sidewalls permitting a similar cup to be nested therein, the cup further comprising a socket generally centered in its bottom surface, the socket having an opening therein;

a generally frustoconical resilient flange surrounding the cup, the flange sloping downwardly and radially outwardly from the rim of the cup, the lower lip of the flange extending below the bottom of the cup when it is in its uncompressed state;

a flag pole for anchoring the apparatus, the flag pole adapted to extend through the opening in said socket and embed in the ground below the cup, the flag pole including a plug for engaging the socket to hold the cup down and compress the resilient flange to hold the lip of the flange against the ground.

10. The game apparatus according to claim 9 wherein the bottom of the cup has a generally conical shape, is raised in the center and slopes downwardly radially outwardly, and wherein the socket is located in the generally raise center.

11. The game apparatus according to claim 9 wherein the sides of the socket and of the plug have a complementary taper.

12. The game apparatus according to claim 9 further comprising a plurality of indicators, the indicators adapted to be anchored in the ground in spaced apart relation to define the path for the game ball between them.

13. The game apparatus according to claim 12 wherein there are at least two pairs of indicators for each hole, each pair of indicators including means for indicating a left or a right turn.

* * * * *